US011482797B2

(12) United States Patent
Henrici et al.

(10) Patent No.: US 11,482,797 B2
(45) Date of Patent: Oct. 25, 2022

(54) ELECTRICAL CONNECTION TERMINAL

(71) Applicant: BJB GmbH & Co. KG, Arnsberg (DE)

(72) Inventors: Philipp Henrici, Arnsberg (DE); Olaf Baumeister, Sundern (DE); Markus Nasse, Hamm (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 17/140,971

(22) Filed: Jan. 4, 2021

(65) Prior Publication Data

US 2021/0234287 A1 Jul. 29, 2021

(30) Foreign Application Priority Data

Jan. 27, 2020 (DE) ..... 102020101857.6

(51) Int. Cl.
*H01R 4/18* (2006.01)
*H01R 12/53* (2011.01)
*H01R 12/57* (2011.01)

(52) U.S. Cl.
CPC ..... *H01R 4/184* (2013.01); *H01R 12/53* (2013.01); *H01R 12/57* (2013.01)

(58) Field of Classification Search
CPC ..... H01R 4/023; H01R 4/18; H01R 4/183; H01R 4/184; H01R 4/20; H01R 4/28; H01R 4/48; H01R 12/53; H01R 12/57; H01R 12/59
USPC ..... 174/74 R, 75 F, 84 R, 88 R, 94 R, 95 S, 174/84 C
See application file for complete search history.

(56) References Cited

U.S. PATENT DOCUMENTS

| | | | | |
|---|---|---|---|---|
| 9,263,822 | B2 * | 2/2016 | Wu | H01R 13/629 |
| 9,444,155 | B2 * | 9/2016 | Chen | H01R 4/4845 |
| 9,472,871 | B2 * | 10/2016 | Lin | H01R 12/53 |
| 9,548,564 | B2 * | 1/2017 | Wu | H01R 4/4836 |
| 9,570,817 | B1 * | 2/2017 | Wang | H01R 4/4818 |
| 9,735,479 | B2 * | 8/2017 | Chen | H01R 12/57 |
| 9,799,968 | B2 * | 10/2017 | Lin | H01R 12/515 |
| 2005/0287878 | A1 * | 12/2005 | Urbaniak | H01R 4/185 439/856 |
| 2006/0292937 | A1 * | 12/2006 | Morello | H01R 13/113 439/856 |
| 2012/0244756 | A1 * | 9/2012 | Jouas | H01R 13/193 439/660 |

(Continued)

FOREIGN PATENT DOCUMENTS

| | | | |
|---|---|---|---|
| DE | 102013111649 | A1 | 5/2014 |
| DE | 102015105383 | A1 | 10/2015 |

(Continued)

*Primary Examiner* — William H. Mayo, III
(74) *Attorney, Agent, or Firm* — Von Rohrscheidt Patents

(57) ABSTRACT

An electrical terminal clamp includes a contact cage including a contact floor, a contact ceiling, a first contact side wall and a second contact side wall that connect the contact floor and the contact ceiling. The contact floor, the contact ceiling, the first contact side wall and the second contact side wall jointly form a conductor insertion channel. A conductor clamping device that includes at least one clamping spring that is preloaded against a reaction bearing and an insertion bevel for a conductor configured in a portion of the contact ceiling, wherein the insertion bevel is formed by a guide arm that extends from the contact ceiling in the conductor insertion direction and that is configured sloped towards the contact floor.

7 Claims, 7 Drawing Sheets

(56) References Cited

U.S. PATENT DOCUMENTS

| | | | | |
|---|---|---|---|---|
| 2015/0311603 | A1* | 10/2015 | Bishop | H01R 4/4818<br>439/856 |
| 2016/0049745 | A1* | 2/2016 | Jin | H01R 12/515<br>439/733.1 |
| 2016/0099528 | A1* | 4/2016 | Lin | H01R 12/53<br>439/638 |

FOREIGN PATENT DOCUMENTS

| | | | |
|---|---|---|---|
| DE | 102015209224 | A1 | 12/2015 |
| DE | 202015104961 | u1 | 12/2016 |
| DE | 202018102775 | U1 | 8/2019 |
| DE | 102019112026 | A1 | 11/2019 |
| DE | 112018002149 | T5 | 1/2020 |
| EP | 3159974 | A1 | 4/2017 |
| EP | 3429031 | A1 | 1/2019 |

* cited by examiner

EDGE TRANSVERSAL TO INSERTION DIRECTION FACING THE OTHER OF THE TWO COMPONENTS OF THE CONTACT CEILING

ELECTRICAL CONNECTION TERMINAL

RELATED APPLICATIONS

This application claims priority from and incorporates by reference German patent application DE 10 2020 101 857.6 filed on Jan. 27, 2020.

FIELD OF THE INVENTION

The invention relates to an electrical terminal clamp.

BACKGROUND OF THE INVENTION

A generic electrical terminal clamp is known e.g. from EP 3 159 974 A1. This is a terminal clamp configured to be arranged on a circuit board. Thus, the contact floor of the contact cage forms a respective connection portion at a front end and a back end viewed in an insertion direction of the conductor wherein the connection portion is contacted at the circuit board in particular through a soldered connection.

A connection conductor can be inserted into the conductor insertion channel with an insulation stripped end facing forward. The connector insertion channel is configured to feed the conductor into a clamping device where the conductor is retained. The clamping device is openable by a disengagement tool that is insertable into a separation gap between the clamping spring and the reaction bearing so that the clamping spring is separated from the reaction bearing against a spring tension of the clamping spring. This facilitates to remove a conductor from the terminal clamp when the conductor sits between the reaction bearing and the clamping spring. However, it is also possible to open the clamping device in the same manner in order to insert the conductor into the clamping device essentially without resistance. This is particularly helpful for multistrand conductors to prevent a frazzling of a free conductor insertion end.

In order to facilitate correct conductor guidance in a vertical plane, thus in a plane that extends between the contact base and the contact ceiling a housing made from insulating material in the terminal clamp according to EP 3 159 974A1 forms an insertion bevel arranged in a portion of the contact ceiling. The insertion bevel tapers from the contact ceiling to the contact base in a direction towards the clamping device.

This serves the purpose to guide the conductor to the clamping device reliably by the bevel formed by the insulator housing. However the proposed solution causes complex fabrication. Generic terminal clamps typically have a width that does not exceed 3 mm to 4 mm at a height that is approximately the same and a length of approximately 8 mm. Due to these very small dimensions the insulator housings that envelop the terminal clamps have to be fabricated with high precision in particular when they perform a conductor guiding function.

BRIEF SUMMARY OF THE INVENTION

Thus, it is an object of the invention to provide a terminal clamp with a guide function that can be manufactured in a simpler and more effective manner.

The object is achieved by an electrical terminal clamp including a contact cage including a contact floor, a contact ceiling, a first contact side wall and a second contact side wall that connect the contact floor and the contact ceiling, wherein the contact floor, the contact ceiling, the first contact side wall and the second contact side wall jointly form a conductor insertion channel; a conductor clamping device that includes at least one clamping spring that is preloaded against a reaction bearing; an insertion bevel for a conductor configured in a portion of the contact ceiling, wherein the insertion bevel is formed by a guide arm that extends from the contact ceiling in the conductor insertion direction and that is configured sloped towards the contact floor.

It is a particular advantage of the invention that the guide arm that forms the insertion bevel is formed by the contact cage of the connection terminal itself, thus by the metal contact material. This makes guiding the conductor into the clamping device independent from the insulator material housing. Thus, the terminal clamp according to the invention can be used with or without insulator material housing.

In an advantageous embodiment the conductor terminal clamp connection is formed by a clamping spring that extends from the first contact sidewall in the conductor insertion direction and by a reaction bearing that extends from the second contact sidewall in the conductor insertion direction.

Thus, the reaction bearing can be a rigid wall section that is connected e.g. with the contact floor. In an advantageous embodiment the reaction bearing is configured as a second clamping spring wherein both clamping springs are preloaded in a direction of a vertical longitudinal contact center plane, thus preloaded relative to each other. Thus, the free ends of the clamping springs contact each other and can furthermore include an integrally formed clamping wedge. When a clamping wedge is provided the clamping wedges of both clamping springs are oriented towards each other.

Furthermore, the clamping spring and/or the reaction bearing include tool engagement features configured to open the clamping device.

This assures that the clamping device can be opened to remove an inserted conductor from the terminal clamp or to insert a multistrand conductor into the clamping device resistance free.

Furthermore, the support arm can include a free end that is oriented away from the contact ceiling wherein the free end is arranged upstream of the tool engagement feature in the conductor insertion direction.

This embodiment assures that the guide arm does not obstruct a tool engagement for opening the clamping device.

When it is assured that the clamping spring and/or the reaction bearing functions as a support for the guide arm it is also assured that the guide arm cannot move between the clamping springs that have been spread by an opening tool which would prevent the clamping device from closing.

It is furthermore provided that the conductor insertion channel has an essentially rectangular cross section where the contact side walls are oriented orthogonal to the contact floor and the contact ceiling.

In this embodiment the contact base and the contact ceiling as well as the contact side walls are configured essentially without camber. Typically, the contact frame that is made from a piece of sheet metal is only cambered in a transition between the wall and the base or corner portions that form the wall and the ceiling which is only due to fabrication techniques.

It is an essential advantage of this embodiment that a larger cross section is provided compared to a circular cross section while maintaining identical outer dimensions with respect to height and width. This facilitates automated insertion of connection conductors. Additionally it also facilitates that the clamping springs or the clamping spring and the reaction bearing as well as the guide arm can be integrally formed more easily at non-cambered wall, ceiling and floor sections of the conductor insertion channel since the clamping springs as well as the guide arms can only develop their optimum mechanical effect when they are non-cambered components.

The invention furthermore proposes that the contact ceiling is only connected on one side at the first or second contact side wall.

Particularly advantageously the contact ceiling is configured in two pieces with a separation gap that is configured in the conductor insertion direction, wherein the guide arm is only connected at one of the contact ceiling elements. Ideally the separation gap divides the contact ceiling in half. A contact ceiling thus configured assures symmetrical opening of the clamping springs that form the clamping device when a conductor is inserted. Thus, both clamping springs are deflected in the same manner. This improves support of the conductor and is furthermore essential for subsequent opening of the clamping device, Only symmetrical deflection of the clamping springs assures that a disengagement tool can open both clamping springs upon insertion of the disengagement tool into the clamping device which is due to the small dimensions of the connection clamp.

The separation gap that is unavoidable when the terminal clamp is made from a sheet metal strip can be arranged in an optimum manner in the contact ceiling since no forces are caused by the clamping device at this location contrary to the contact side walls.

BRIEF DESCRIPTION OF THE DRAWINGS

Further advantages of the invention and a better comprehension thereof can be derived from the subsequent description of an advantageous embodiment with reference to drawing figures, wherein.

DETAILED DESCRIPTION OF THE INVENTION

Figure 1:
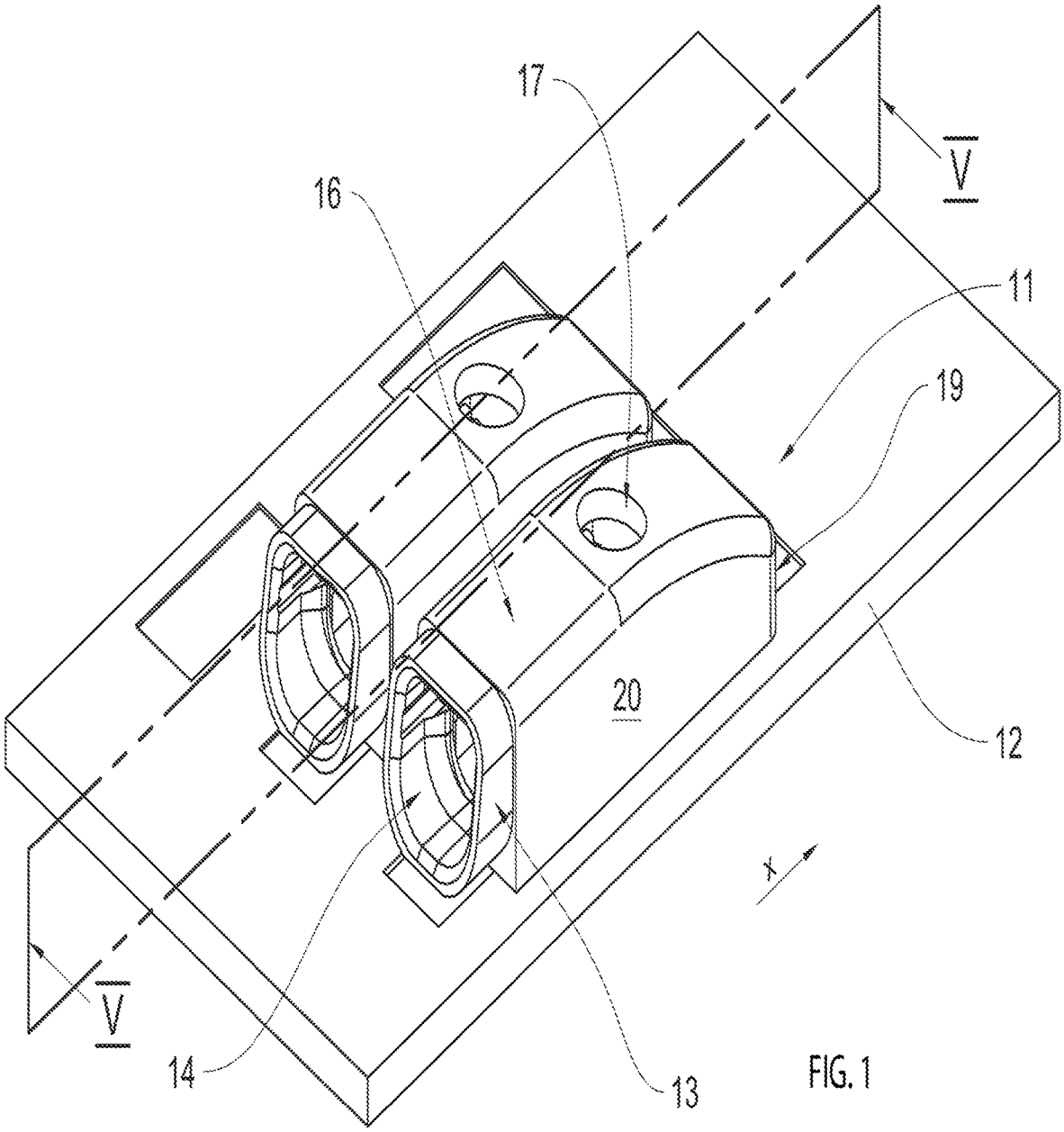
FIG. 1 illustrates a circuit board with two terminal clamps according to the invention that are arranged adjacent to one another.

The electrical terminal clamp according to the invention is designated overall with reference numeral 10 in the drawing figures.

In FIG. 1 the electrical terminal clamp 10 includes an insulating material housing 11 and is placed on a schematically illustrated circuit board 12.

The insulating material housing 11 includes a collar 13 that envelops a conductor insertion opening 14 that is formed by the insulating material housing 11 and that is arranged upstream of the conductor insertion opening 15 of the electrical terminal clamps 10 in the conductor insertion direction x.

Furthermore, the insulating material housing 11 includes a tool recess 17 in a ceiling wall 16 wherein a tool is insertable into the insulating material housing 11 through the tool recess 17 in order to open a clamping device 18 of the electrical terminal clamp 10.

The insulating material housing 11 includes a rear wall 19 at a side that is oriented away from the collar, Additionally, the insulating material housing 11 includes two side walls 20 arranged opposite to each other.

Figure 4:
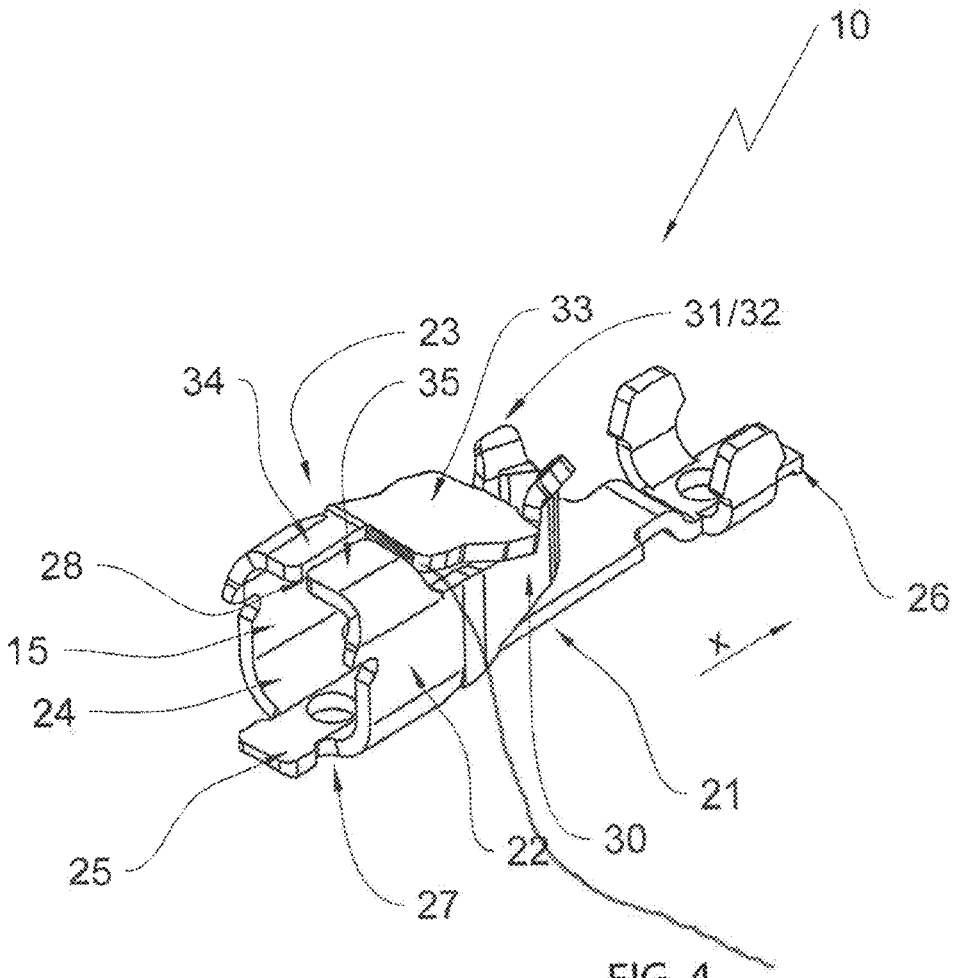
FIG. 4 illustrates the representation according to FIG. 3 without the terminal conductor.

FIG. 4 illustrates the electrical terminal clamp 10 by itself. The electrical terminal clamp 10 includes a contact floor 21 where two contact side walls 22 are integrally formed that extend upward approximately orthogonal to the contact floor 21. A contact ceiling 23 is integrally formed at the contact side walls 22 and oriented approximately parallel to the contact floor 21. The contact floor 21 envelops a conductor insertion channel 24 together with the contact side walls 22 and the contact ceiling 23.

The contact floor 21 includes a first contact base 25 at an end that is upstream of the conductor insertion opening 15 of the conductor insertion channel 24 in the insertion direction x and includes a second contact base 26 at an end that is downstream of the conductor insertion channel 24 in the conductor insertion direction x. The first and the second contact base are arranged in a common plane. A section of the contact floor 21 that forms the channel floor 27 of the conductor insertion channel 24 is arranged in the same plane as the contact bases 25 and 26. The contact floor 21 is raised relative to the plane of the contact bases 25, 26 in a direction towards the contact ceiling between the channel floor 27 and the second contact base 26 that is arranged at a rear end of the electrical terminal clamp 10.

The contact side walls 22 extend from the section of the contact base 21 that forms the channel base 27 and do not extend in the conductor insertion direction x beyond a length of the channel floor 27. Therefore, the contact side walls 22 can also be designated as channel side walls.

Likewise, the contact ceiling 23 extends in the conductor insertion direction x at the most over a length of the channel base so that the contact ceiling 23 can also be designated as channel ceiling.

The channel ceiling 23 is configured in two components wherein a separation gap 28 that extends in the conductor insertion direction x between the two ceiling elements. Ideally the separation gap divides the contact ceiling in half, A contact ceiling thus provided assures symmetrical opening of the clamping springs that form the clamping location when the conductor is inserted. Thus, both clamping springs are deflected identically. This improves support of the conductor and is furthermore essential for a subsequent opening of the clamping device. Only the symmetrical deflection of the clamping springs assures that a disengagement tool can open both clamping springs when the disengagement tool is inserted into the clamping device which is in particular due to the small dimensions of the clamping device.

The cross section of the conductor insertion channel 24 is essentially rectangular and approximately square in an advantageous embodiment. The channel side walls 22, the channel base 21 as well as the channel ceiling 23 are essentially non-cambered. They are only cambered in corner portions where the channel side walls 22 transition into the channel floor 21 or the channel ceiling 23. These radii are essentially due to the fabrication techniques. These are bending radii that are caused by stamping and bending the electrical terminal clamp 10 from a metal blank.

The rectangular, advantageously square cross section of the conductor insertion channel 24 has a substantial advantage over a rounded, in particular circular conductor insertion channel 24 that the cross sectional surface is larger for identical outer dimensions with respect to width and height. This facilitates automated insertion of connection conductors since larger tolerances are possible with respect to positioning the insertion tool relative to the electrical terminal clamp 10.

Two clamping springs 30 extend from the channel or contact side walls 22 in the conductor insertion direction x wherein free ends of the clamping springs contact each other in a portion of a vertical longitudinal sectional plane of the electrical terminal clamp 10 that extends in the conductor insertion direction x. In an advantageous embodiment the free ends of the clamping arms that contact each other are spring loaded. However, it is sufficient when the clamping springs 30 are sufficiently proximal to each other with their free ends. Depending on the conductor cross sections provided even a gap between the free ends can be tolerated. The clamping springs 38 form the clamping device 18 of the electrical terminal clamp 18.

Thus, a respective tool engagement device 31 extends in upward direction, thus away from the contact base at each clamping spring 30. These are spreading tongues 32 that are deflected slightly outward. An opening tool can be inserted between the spreading tongues to spread the clamping springs 30 and to open the clamping device 18 to provide no resistance insertion or removal of a connecting conductor.

In order to assure reliable feeding of the connection conductor to the clamping device 18 a guide arm 33 extends from the contact or channel ceiling 23 in the conductor insertion direction x and is configured sloped in a direction towards the contact floor 21 from the location where it is connected to the contact ceiling 23. Therefore, the free end of the guide arm 33 is closer to the contact floor 21 than a root of the guide arm that is connected to the contact ceiling 23.

In the embodiment where the contact or channel ceiling 23 is configured in two components the guide arm 33 only originates from the first ceiling portion 34. The second ceiling portion 35 is configured without the guide arm. However, the guide arm 33 spans the channel width so that a conductor that is to be inserted cannot exit the channel or the clamping portion that is arranged behind the conductor insertion channel in an upward direction thus in a direction that is oriented away from the channel base.

The guide arm 33 can contact the clamping springs 30 which then form a reaction bearing. This has the essential advantage that the maximum possible inclination of the guide arm 33 towards the contact floor 21 is useable for conductor guidance. It is appreciated that the free end of the support arm 33 is arranged in the conductor insertion direction x upstream of the tool engagement devices 31 of the clamping springs 30 so that free access to the tool engagements devices 31 is assured. Furthermore, the guide arm 33 has a trapezoid expansion in an end section that is proximal to the free end in order to prevent an entry of the free guide arm end into the clamping device 18 when the clamping device 18 is open by a maximum amount since this would prevent a reset of the spread, opened clamping springs 30 and thus cause a defect of the electrical terminal clamp 10.

Figure 3:
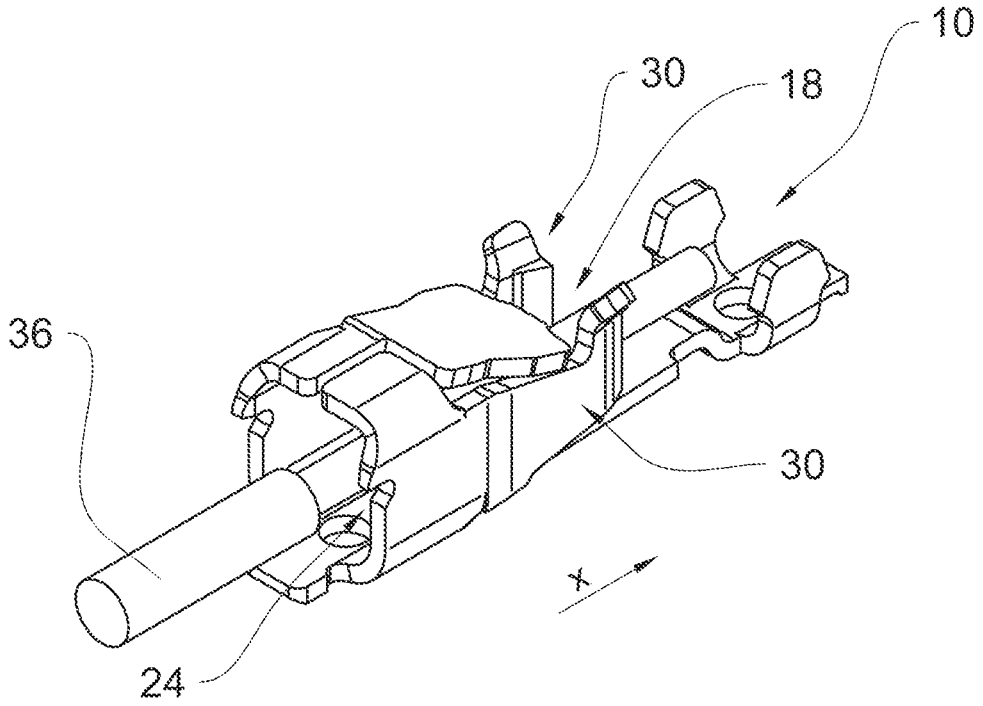
FIG. 3 illustrates an electrical terminal clamp with an inserted connection conductor.

FIG. 3 illustrates a representation analogous to FIG. 4 with the difference that a connection conductor 36, a cable with an insulation stripped end was inserted in conductor insertion direction x through the conductor insertion opening 15 and the conductor insertion channel 24 into the clamping device 18. Thus, the clamping springs 30 are spread outward so that a spring tension was created that is oriented opposite to the spreading movement. The clamping edges of the clamping springs 30 contact the insulation stripped end of the connection conductor 36 and retain the connection conductor in the clamping device 18 against retraction forces.

Figure 2:
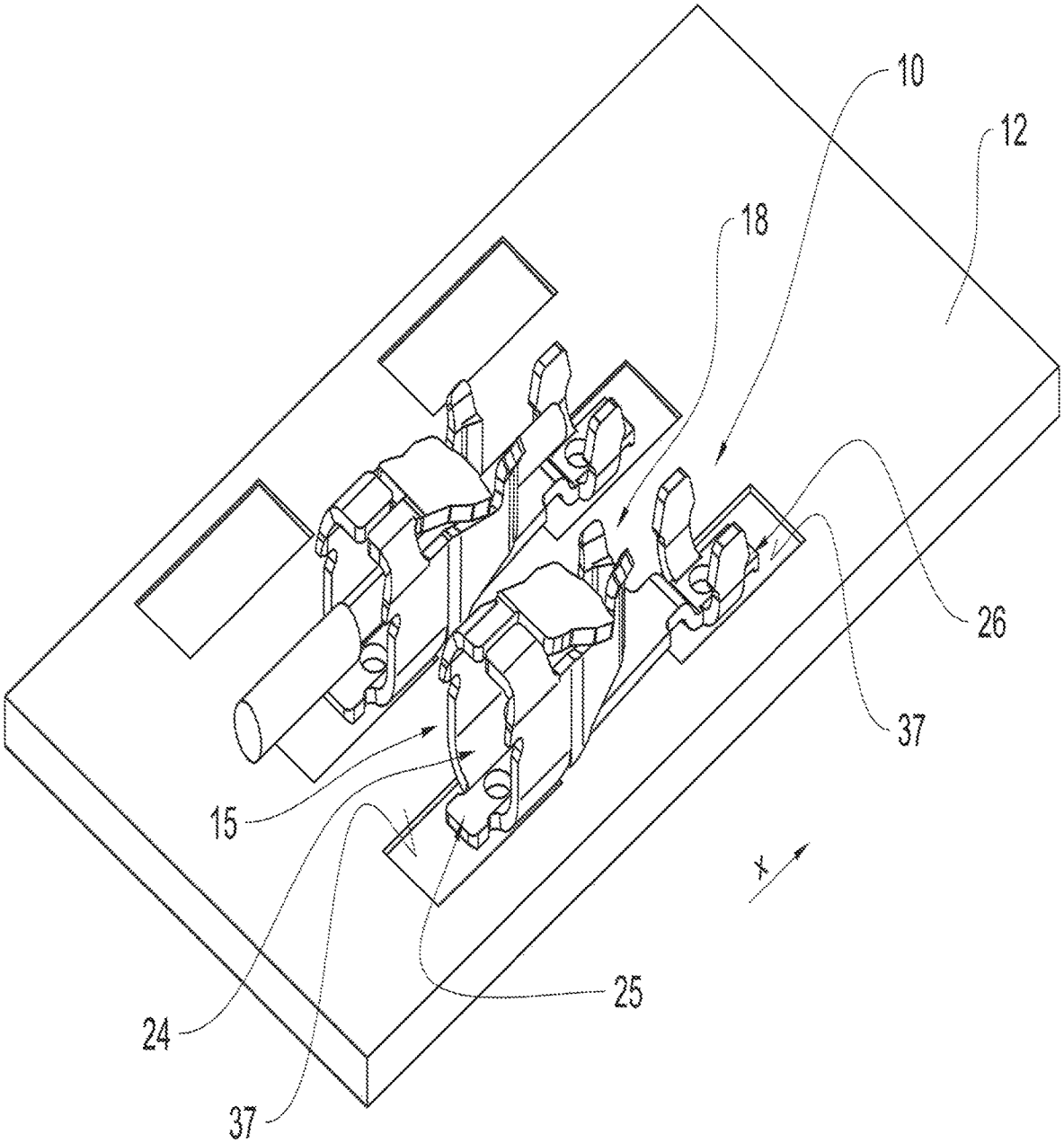
FIG. 2 illustrates the representation of FIG. 1 supplemented by a terminal conductor and without the insulating synthetic material housing.

FIG. 2 illustrates the representation according to FIG. 1, however omitting the insulation material housing 11. Thus, the connection conductor 36 recited supra is inserted in one of the two terminal clamps. The electrical terminal clamps 10 contact the circuit board 12 with contact bases 25 and 26 on contact surfaces 37 of the circuit board and are attached to the contact surface in an electrically conductive manner e.g., by a soldering process.

Figure 5:
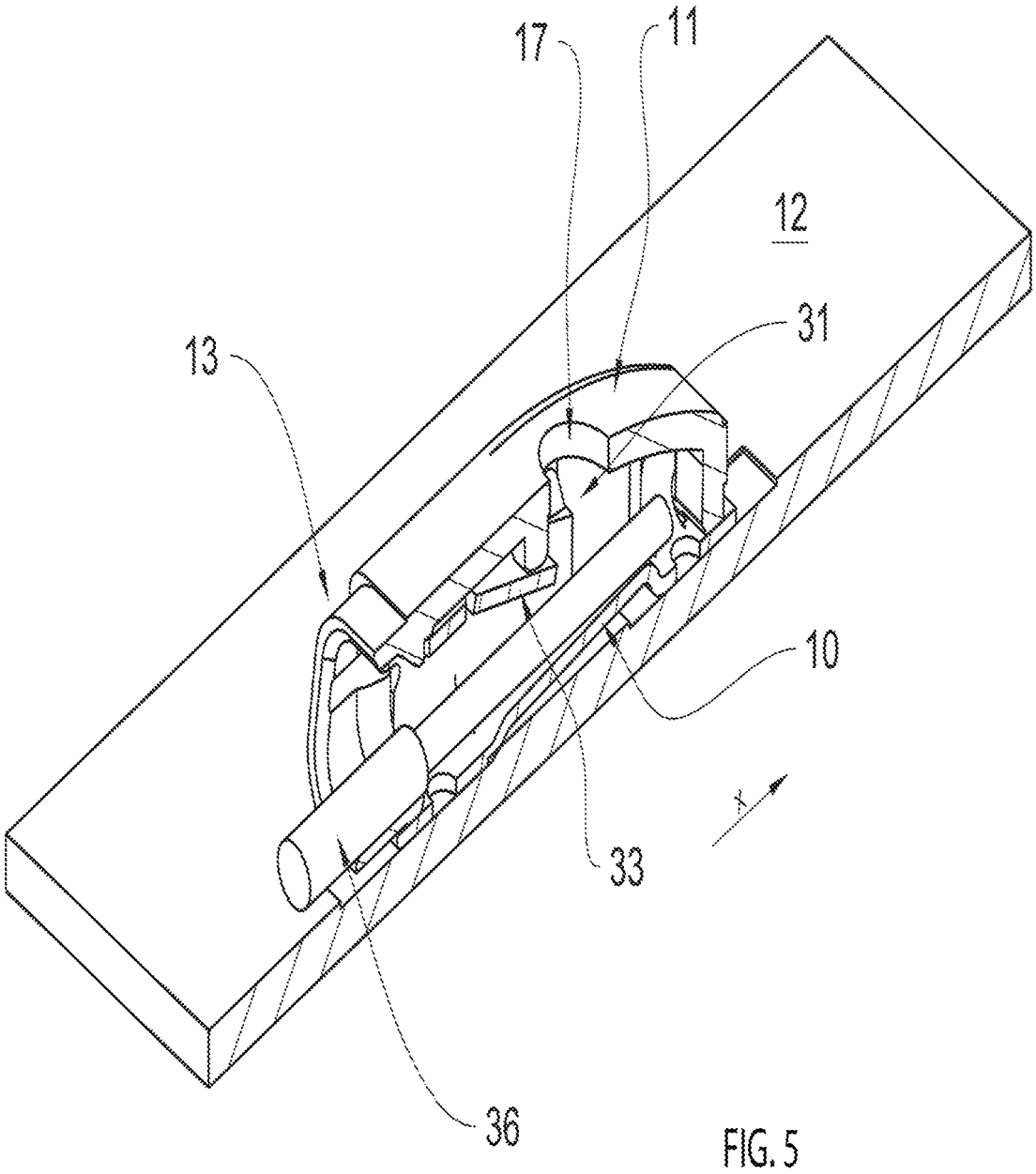
FIG. 5 illustrates a sectional view in the sectional plane A-A in FIG. 1.
Figure 6:
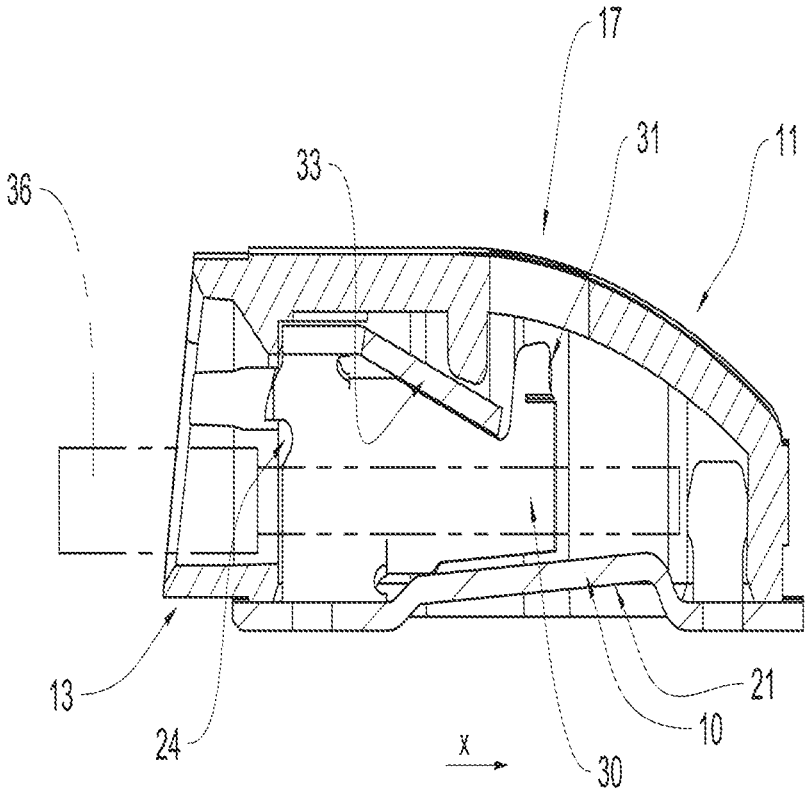
FIG. 6 illustrates a sectional view according to FIG. 5 without the circuit board.

FIGS. 5 and 6 show the electrical terminal clamp 10 including the insulation material housing 11 and the circuit board 12 in a sectional view according to section line A-A in FIG. 1. From these illustrations it is evident that the collar 13 of the insulation material housing 11 is arranged upstream of the conductor insertion opening 15 or the conductor insertion channel 24 of the electrical terminal clamp 10 in the conductor insertion direction x. It is furthermore evident that the tool recess 17 of the insulation material housing 11 is arranged above the tool engagements 31 of the clamping springs 30 so that a disengagement tool is insertable into the clamping device 18 through the tool recess 17.

FIGS. 5 and 6 show the slope of the guide arm 33 in a direction towards the contact floor 21 and the associated guide effect for a connection conductor 36 in a direction towards the clamping device 18. Due to the guide arm 33 an escapement of the connection conductor 36, in particular of its insulation stripped end that is to be fed to the clamping device 18 is excluded in an upward direction towards the insulation material housing 11. This assures reliable contacting between the electrical terminal clamp 10 and the connection conductor 36 in the clamping device 18.

Figure 7:
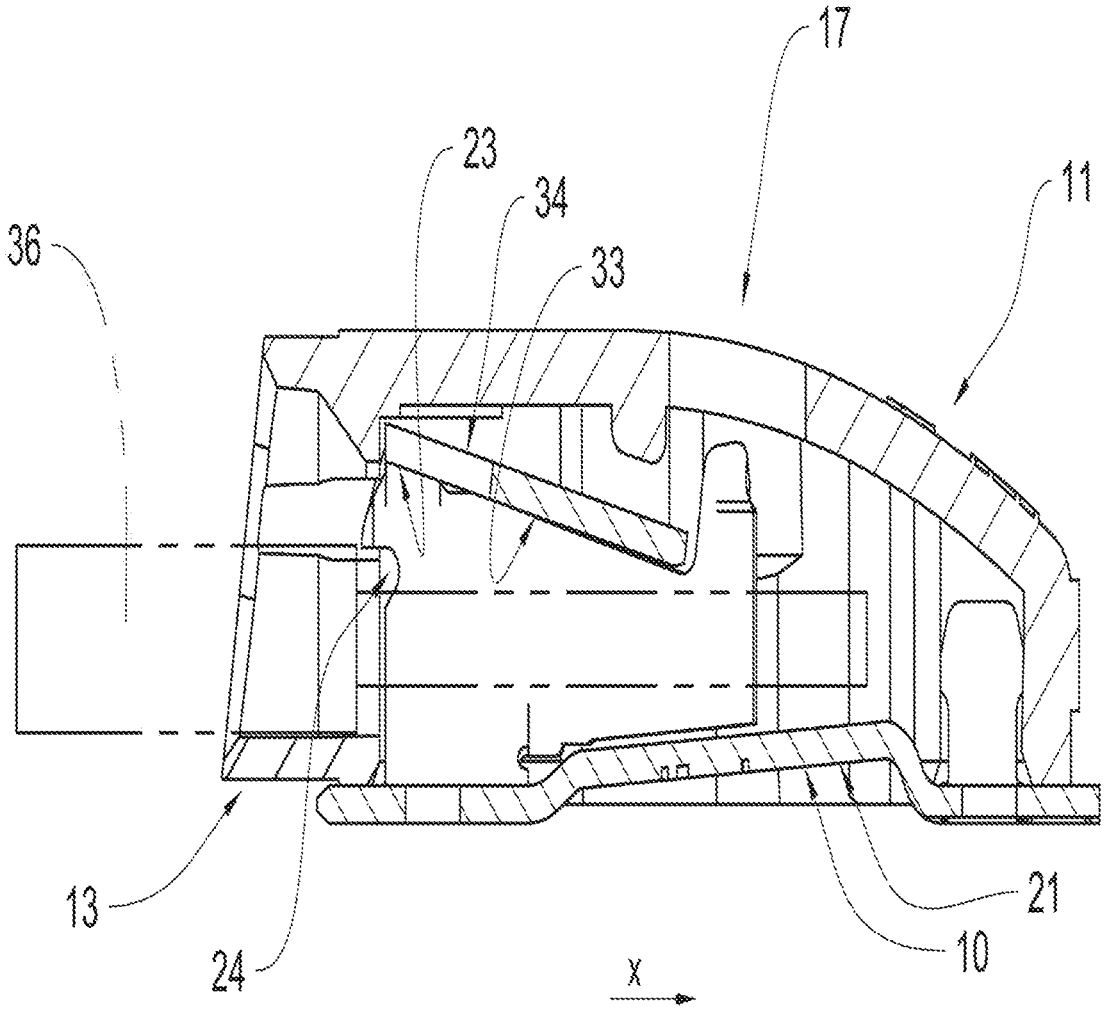
FIG. 7 illustrates an alternative embodiment of the terminal clamp.

FIG. 7 shows an alternative embodiment of the electrical terminal clamp 10. The representation of FIG. 7 thus corresponds to the representation of FIG. 6, only the contact ceiling 23 is configured differently. In so far, the description regarding the first embodiment that is illustrated in FIGS. 1-6 also applies to the second embodiment illustrated in FIG. 7. In this second embodiment the contact ceiling 23 that is divided in two in conductor insertion direction x is sloped in a direction towards the contact floor 21, wherein the slope of the contact ceiling 23 corresponds to the slope of the guide arm 33. This prevents a contacting of the conductor 36 at a kink that is provided in the first embodiment between the contact ceiling 23 and the guide arm 33 when the conductor 36 is inserted into the clamping device.

REFERENCE NUMERALS AND DESIGNATIONS

10 electrical terminal clamp
11 insulating material housing
12 circuit board
13 collar of 12
14 conductor insertion recess
15 conductor insertion opening
16 ceiling wall
17 tool recess
18 clamping device of 10
19 rear wall of 11
20 side wall
21 contact floor

22 contact side wall
23 contact ceiling
24 conductor insertion channel
25 first contact base
26 second contact base
27 channel floor
28 separation gap
30 clamping spring
31 tool engagement device
32 spreading tong
33 guide arm
34 first ceiling component
35 second ceiling component
36 connection conductor
37 contact surface
x conductor insertion direction

What is claimed is:

1. An electrical terminal clamp comprising:

a contact cage including, a contact floor, a contact ceiling, a first contact side wall and a second contact side wall that connect the contact floor and the contact ceiling, wherein the contact floor, the contact ceiling, the first contact side wall and the second contact side wall jointly form a conductor insertion channel;

a conductor clamping device that includes at least one clamping spring that is preloaded against a reaction bearing;

an insertion bevel for a conductor configured in a portion of the contact ceiling, wherein the insertion bevel is formed by a guide arm that extends from the contact ceiling in the conductor insertion direction and that is configured sloped towards the contact floor, wherein the contact ceiling is configured in two components with a separation gap there between oriented in the conductor insertion direction, wherein the guide arm is attached exclusively at one component of the two components of the contact ceiling, and wherein the guide arm includes an edge oriented transversal to the insertion direction and facing the other of the two components of the contact ceiling.

2. The electrical terminal clamp according to claim 1, wherein the conductor clamping device is formed by a clamping spring that extends from the first contact side wall in the conductor insertion direction and by a reaction bearing that extends from the second contact side wall in the conductor insertion direction.

3. The electric s terminal clamp according to claim 2, wherein the at least one clamping spring or the reaction bearing support the guide arm.

4. The electrical terminal clamp according to claim 1, wherein the at least one clamping spring or the reaction bearing include, tool engagement devices configured to open the clamping device.

5. The electrical terminal clamp according to claim 4, wherein the guide arm includes a free end that is oriented away from the contact ceiling and that is arranged upstream of the tool engagement devices in the conductor insertion direction.

6. The electrical terminal clamp according to claim 1, wherein the conductor insertion channel has a substantially rectangular cross section, and wherein the first contact side wall and the second contact side wall are oriented orthogonal to the contact floor and the contact ceiling.

7. The electrical terminal clamp according to claim 1, wherein the contact ceiling is attached at the first contact side wall or the second contact side wall exclusively at one side of the contact ceiling.

* * * * *